US006935535B2

(12) United States Patent
Pandolfi et al.

(10) Patent No.: US 6,935,535 B2
(45) Date of Patent: Aug. 30, 2005

(54) HOT WAX DISPENSER

(75) Inventors: Richard Pandolfi, Smithtown, NY (US); Celmira Castillo, Wantagh, NY (US); Julio Castillo, Wantagh, NY (US)

(73) Assignee: Great Bodies Ahead, Inc., Deer Park, NY (US)

( * ) Notice: Subject to any disclaimer, the term of this patent is extended or adjusted under 35 U.S.C. 154(b) by 76 days.

(21) Appl. No.: 10/410,440

(22) Filed: Apr. 10, 2003

(65) Prior Publication Data

US 2004/0200541 A1 Oct. 14, 2004

(51) Int. Cl.[7] ..... B67D 5/00

(52) U.S. Cl. ..... 222/146.5; 222/1; 222/185.1; 141/82; 141/375; 219/385; 606/134

(58) Field of Search ..... 222/1, 146.2, 146.5, 222/185.1; 141/82, 375; 606/134; 219/385, 386, 420–430, 432–436

(56) References Cited

U.S. PATENT DOCUMENTS

| | | | | | |
|---|---|---|---|---|---|
| 1,381,500 | A | * | 6/1921 | Reader | 222/146.2 |
| 3,143,294 | A | * | 8/1964 | Lundin et al. | 239/135 |
| 4,499,367 | A | * | 2/1985 | Schwob | 219/421 |
| 4,919,308 | A | * | 4/1990 | Majkrzak | 222/146.5 |
| 5,847,363 | A | * | 12/1998 | Debourg et al. | 219/424 |

* cited by examiner

*Primary Examiner*—J. Casimer Jacyna
(74) *Attorney, Agent, or Firm*—L. Joseph Marhoefer

(57) ABSTRACT

A hot wax storage tank is supported by an arm extending vertically upward from a base. A heating element on the tank heats the wax to its vicious liquid state suitable for application on a client. A conduit connects an outlet in the bottom of the tank to the input of a control valve. The output of the control valve is directed to an application dish located beneath control valve outlet. By means of the control valve, an operator can dispense only what is required for each client.

12 Claims, 6 Drawing Sheets

SECTION VIEW A–A

SECTION VIEW B-B

SECTION VIEW A-A

HOT WAX DISPENSER

BACKGROUND OF THE INVENTION

1. Field of the Invention

This invention relates to a hot wax depilatory dispensing system, and more particularly a system that improves the hygienic use of a hot wax depilatory to remove body hair.

2. Description of the Prior Art

Hair removal services using hot wax depilatories are offered in spas, hair and nail salons, specialty shops, and other similar business establishments. Typically, an operator dips an applicator (e.g. a stick, spatula or the like) into a can, bottle, or vat of wax depilatory that has been heated to a usable viscous liquid state. The operator, after dipping the applicator/spatula into the heated high viscosity wax, applies the wax to the area where the hair is to be removed. After the application of wax, gauze like fabric is placed on the still hot wax. After several minutes, the gauze like fabric is sharply pulled from the area, removing the hair from the area along with now cooled and hardened wax. The process is performed on small areas such as eyebrows, and large areas such as a client's leg.

In the industry, the spas, salons, etc purchase hot wax depilatory products in standard sized containers (typically 10—6-ounce containers). To prepare for application, the container is opened and placed on a heating device similar to a hot plate. When the wax is heated to a suitable temperature, the operator dispenses the melted wax as described above, using an applicator/spatula. The applicator is continually immersed and re-immersed into the heated, open wax container.

In general, only a small amount of wax is needed to remove hair from the desired area. Each client uses only a small amount of wax from the standard ten-ounce container. A container therefore is typically used for multiple clients. Although the applicator/spatula is changed for each client, its immersion and re-immersion into the same container can cause contamination of the wax in the container due to any client skin irregularities, open wounds, skin disorders, etc.

SUMMARY OF THE INVENTION

An object of this invention is the provision of a system for dispensing a controlled amount of hot wax; for example only the amount needed for a particular client.

Another object of the invention is the provision of a system that includes a sterilization chamber into which the dispensed wax can be placed.

Briefly, the invention contemplates the provision of a hot wax dispensing system in which a hot wax storage tank is supported by an arm extending vertically upward from a base. A heating element on the tank heats the wax to its vicious liquid state suitable for application on a client. A conduit connects an outlet in the bottom of the tank to the input of a control valve. The output of the control valve is directed to an application dish located beneath control valve outlet. By means of the control valve, an operator can dispense only what is required for each client.

DESCRIPTION OF THE PREFERRED EMBODIMENTS

Figure 1:
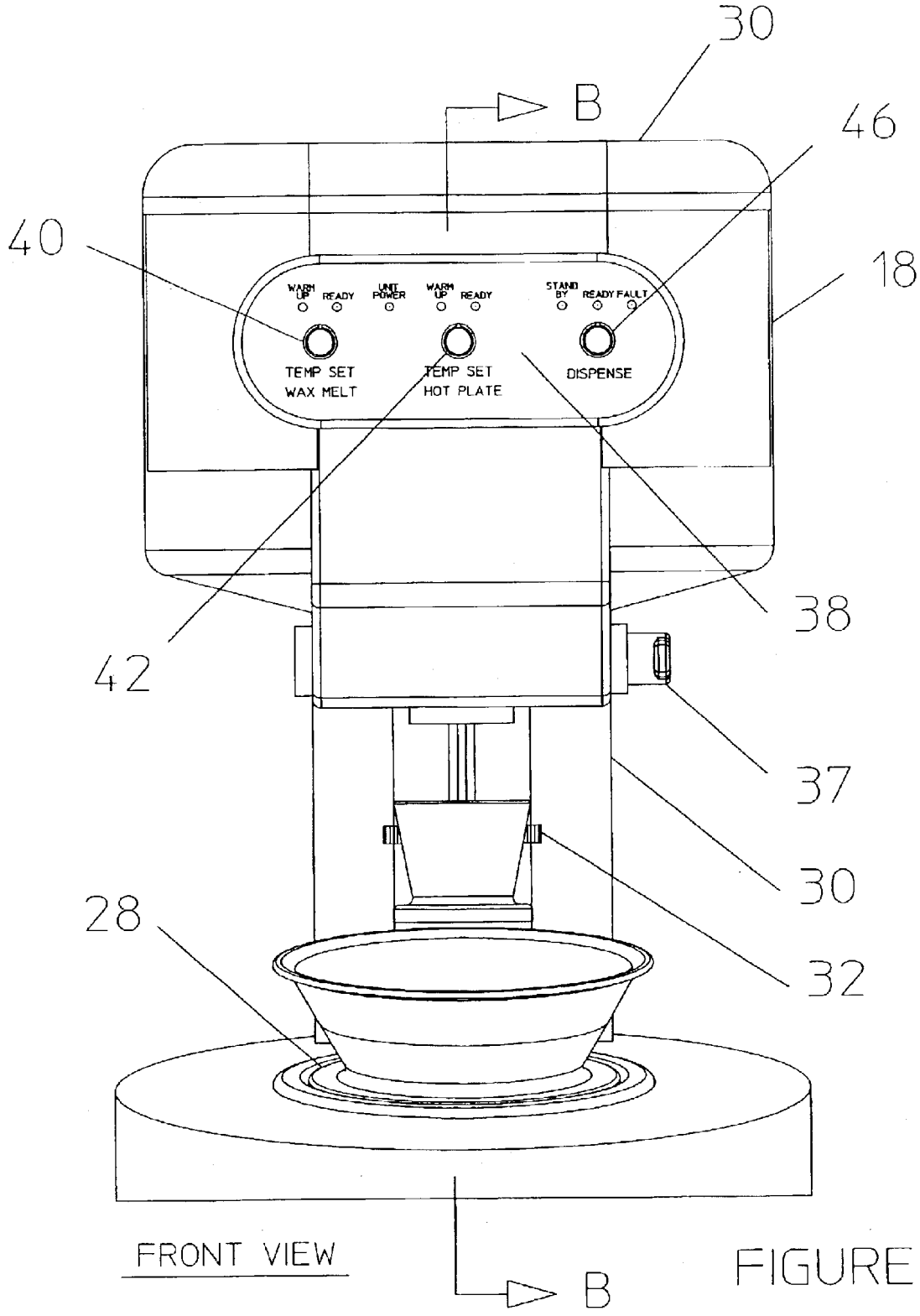
FIG. 1 is a front view of a hot wax dispenser in accordance with one specific embodiment of the invention.
Figure 2:
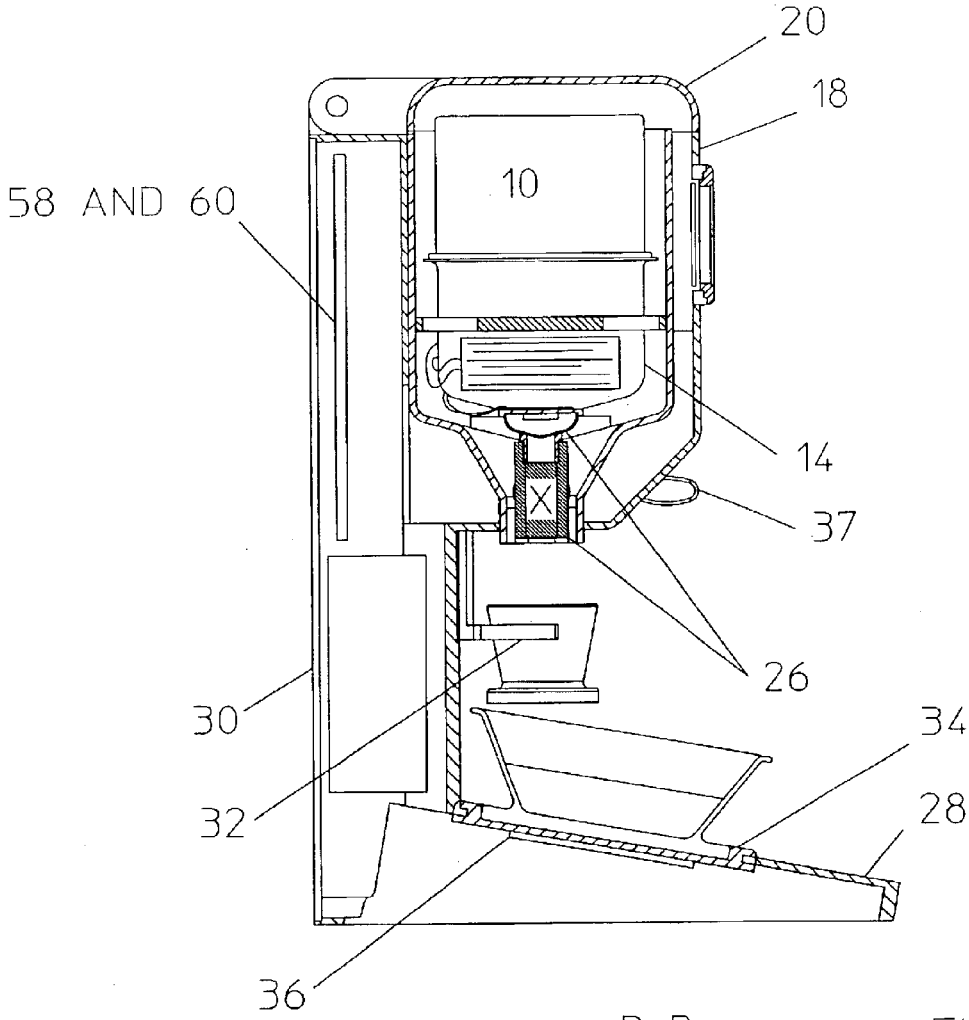
FIG. 2 is a sectional view along the line B—B in FIG. 1.
Figure 3:
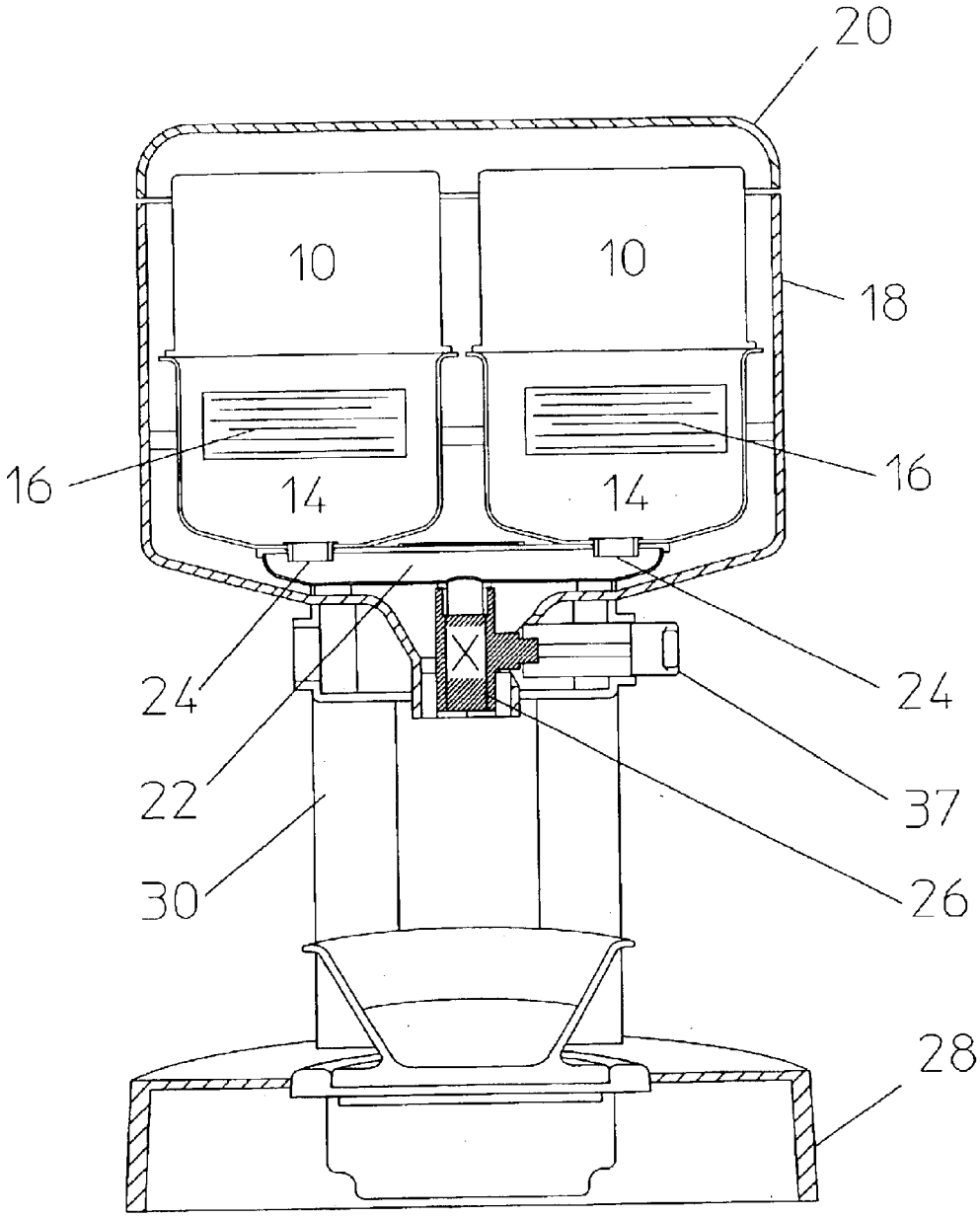
FIG. 3 is a front sectional view along the line A—A of FIG. 2.

Referring now to FIGS. 1–6, this embodiment of the invention can use one or, as shown here, multiple commercially available disposable depilatory wax containers 10. Of course, the invention could be modified to use a single container, if desired. The containers 10, with their open side down, sit respectively atop a pair of heated wax storage tanks 14. Here it should be noted the wax does not flow at room temperature and there is no tendency of the wax spill form its container as it is positioned over its heated wax storage tank. Each storage tank has a heater 16 for heating the hot wax to and maintaining the hot wax at a suitable operating temperature, about 98–110 degrees F. A Kapton self-stick 30-watt heater on each storage tank is satisfactory for this purpose. A housing 18 with a hinged cover 20 surrounds the canisters and the heated storage tanks and supports the storage tanks as well as providing a thermally insulating air space between the storage tanks and the housing wall.

A wax flow manifold 22 couples respective openings 24 in the bottom of the storage tanks to the inlet of wax flow control valve 26 located beneath the storage tanks. The outlet of the flow control valve 26 is directed downward toward the base 28 of the dispenser. If desired, the base may be filled with suitable ballast to provide stability to the upright dispenser. A structure 30 extends upwardly from the base 28 and supports the housing 18, storage tanks 14 and control valve 26. Structure 30 also supports a cup holder 32 for small portions of wax, such as for use on eyebrows. The surface 34 of the base 28 is tilted downward in the direction away from the structure 30 so as to provide easy access to a wax dispensing bowl that can be placed on the upper surface of the base. This surface includes a heat conducting plate 34 with a heater 36 attached to the lower surface of the plate. The same Kapton 30-watt heater used with the storage containers is suitable here. A manually operated flow control lever 37 extends from the valve 26 and allows the operator to dispense a desired amount of wax into the cup or the bowl by rotating the lever between a closed and an open position.

A control panel 38, mounted on the front of the housing, includes a potentiometer 40 for adjusting the temperature of hot wax storage tank, and a potentiometer 42 for adjusting the temperature of heat conducting plate 36. LED display devices on the panel indicate the state of the dispenser; e.g. warm-up; ready; standby, etc. The flow control valve 26 may include a solenoid actuator in addition to the control lever. With solenoid actuation, an operator depresses a button switch 46 on the control panel to open and close the valve when the "READY" LED is lit.

Figure 4:
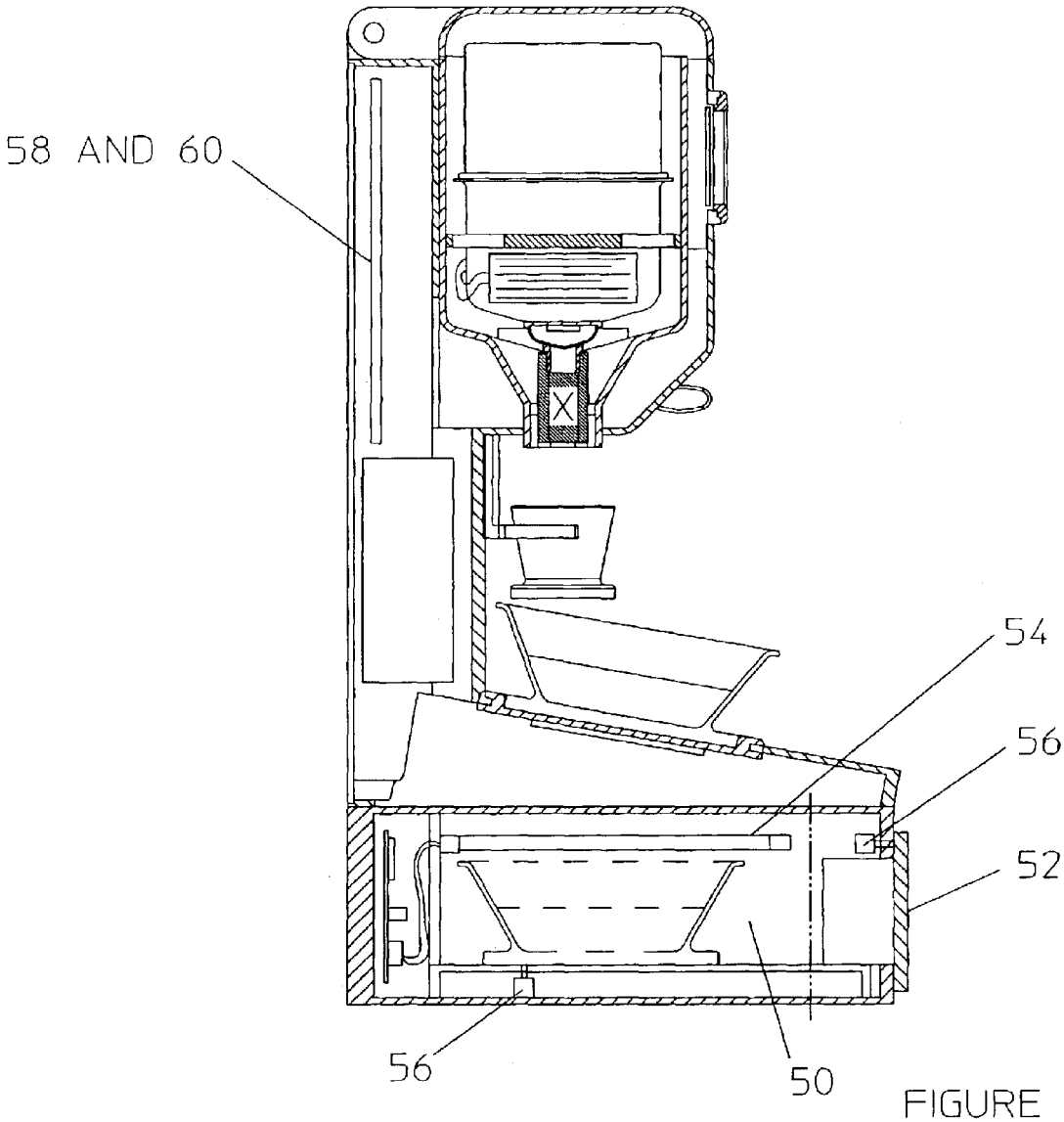
FIG. 4 is a side sectional view of the invention shown in FIGS. 1—3 incorporating a UV chamber for sterilizing dispensed hot wax.
Figure 5:
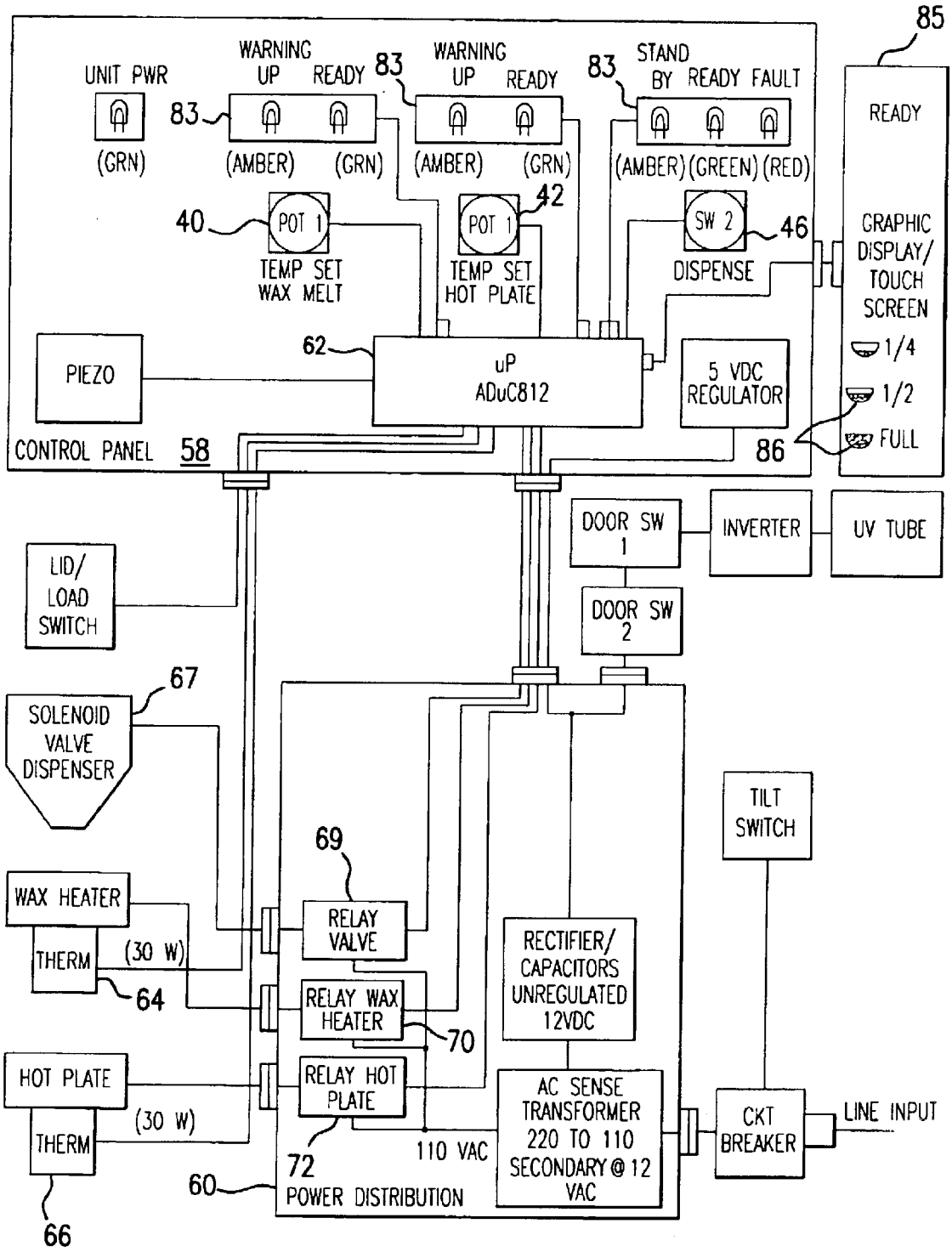
FIG. 5 is a block diagram of a control module and the power distribution module for use of he embodiments of the invention shown in FIGS. 1–4.

As shown in FIG. 4, the base may include a UV sterilization chamber 50 into which a dish of wax may be placed prior to use in order to sterilize the wax. The chamber includes a door 52, and UV tube 54 mounted on the top of the chamber. Interlock switches 56 enable the UV tube to be energized for a timed interval when a wax dish is placed in the chamber, but only if the chamber door is closed and secured. A UV tube inverter is mounted on a wall of the chamber. A power distribution and control board 58 and a power module 60 are mounted in the structure 30.

Figure 6:
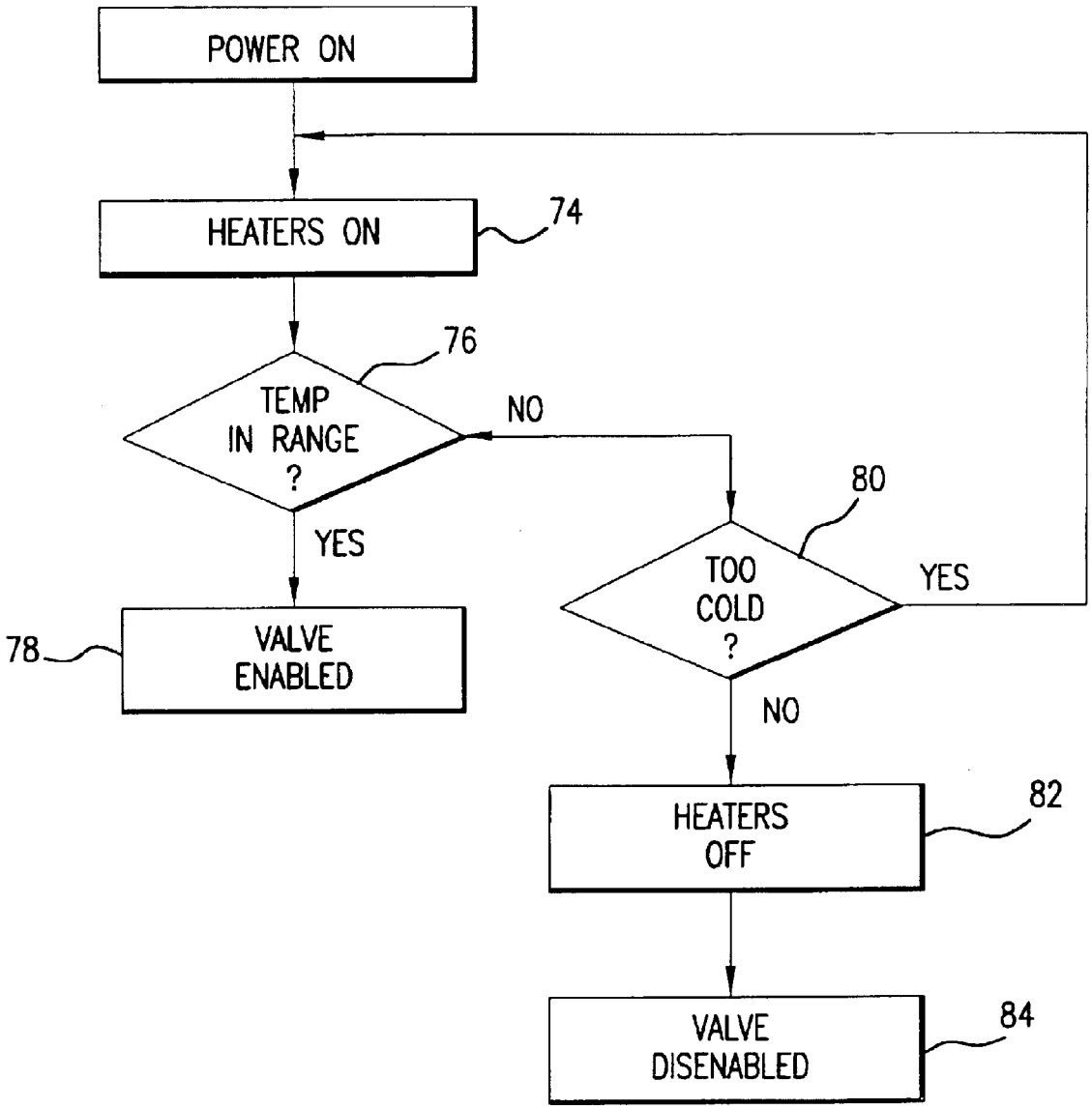
FIG. 6 is a flow diagram showing the operating steps of the invention illustrated in the previous drawings.

Referring now to FIG. 6, it shows both the dispenser display and control module 58, and the power module for the dispenser, 60. The control module includes a microprocessor 62. It has inputs from temperature measuring deices 64 and 66, which respectively monitor the temperature of the wax storage tanks 14 and of the hot plate 36. The processor also receives inputs form the potentiometers 40 and 42 and from the switch 46 that controls the opening and closing of the solenoid flow control valve. In response to these inputs, the processor 62 provides outputs that inform the operator about the status of the dispenser and control the temperature of the wax storage tank and the hot plate via heater relays 70 and 72 respectively. In the semiautomatic dispensing embodiment of the invention, outputs from the processor operate a solenoid flow control valve 67 via a valve relay 69 when the storage tank temperature and the hot plate temperature are within an acceptable range and the operator engages the dispensing switch 81. The dispenser status is indicated by lights 83 (e.g. LEDs) that are illuminated by the processor 62.

In an automatic embodiment of the invention, a touch screen, graphic display 85 provides the operator interface for some or all of operator input/output functions discussed above. The touch screen display module 85 lets the operator select a desired quantity to be dispensed, in an automatic dispensing mode of operation. Icons 86, for example, show one quarter filled, half filled and full dispenser dishes. The touch sensitive display, in response to an operator touching an icon showing the quantity he or she desires, sends a signal to the processor 62. In the automatic operating mode, the processor opens the solenoid valve for a predetermined time interval to dispense the selected quantity. The correlation between time and quantity may be determined empirically and those values stored in memory where they can be accessed by the processor. Of course alpha numeric text messages may be used in place of icons, and status messages such as READY and DISPENSING may be displayed to the operator via the display screen. A flash EPROM may be used for screen storage, firmware for instructions for text and graphics, touch recognition, and a serial data protocol to interface to the processor.

FIG. 7 illustrates the operation of the system for dispensing hot wax in accordance with the teachings of the invention. With the power on, the microprocessor 62 turns the heaters on and Insures the valve is in its closed position, block 74. The inputs to he microprocessor 62 indicate when the temperature of both the storage tanks and the hot plate is within a specified range (i.e. hot enough to heat the wax to a temperature for application but not too hot so as to heat the wax to a temperature that would cause injury or undue discomfort), and a lid switch signals the lid is closed, decision block 76. In this state, when the dispensing switch button 46 is activated, the processor 60 opens the solenoid valve for a predetermined interval in the automatic mode, block 78. As indicated in the drawing, if the wax container is too hot, or the hot plate is too hot, the system turns off the appropriate heater, and also prevents the valve from being opened, blocks 80, 82 and 84.

It is to be understood that the above-described embodiments are merely illustrative of the principles of the invention and that many variations may be devised by those skilled in the art without departing from the spirit and scope of the invention. It is, therefore, intended that such variations be included within the scope of the claims.

What is claimed is:

1. A dispenser for hot depilatory wax comprising in combination:

a base adapted to rest on a generally horizontally extending surface;

a support arm extending vertically from said base;

a housing supported by said arm for receiving two containers of wax and supporting said containers over two wax tanks in said housing so that wax can flow out of said two containers into respectively said two wax tanks;

a heating element for heating wax in each tank;

a flow control valve having an inlet and an outlet;

a heated manifold connecting an opening in each tank to said inlet;

said outlet directing hot wax flowing through said valve toward a plate adapted to support a hot wax-dispensing dish.

2. A dispenser for hot depilatory wax as in claim 1, further including a heater to heat said plate.

3. A dispenser for hot depilatory wax as in claim 1, further including an UV chamber for sterilizing wax in said wax dispensing dish.

4. A dispenser for hot depilatory wax as in claim 1, further including a microprocessor controlled panel that indicates when the temperature of wax in the tank is within a predetermined temperature range.

5. A method for dispensing a hot depilatory wax, including the steps of:

mounting a container of depilatory wax on a tank that is supported over a receptacle for the hot depilatory wax;

heating said tank so that wax flows from said container into said tank;

controlling a gravitational flow of heated wax from said tank to said receptacle by means of a solenoid operated valve so that a desired quantity of wax is dispensed.

6. A method for dispensing a hot depilatory wax as in claim 5 wherein said valve opens for a predetermined interval in response to an operator input.

7. A method for dispensing a hot depilatory wax as in claim 6, wherein said operator input is a touch screen input.

8. A method for dispensing a hot depilatory wax as in claim 5, further including subjecting dispensed wax to UV radiation.

9. A method for dispensing a hot depilatory wax as in claim 6, further including subjecting dispensed wax to UV radiation.

10. A method for dispensing a hot depilatory wax as in claim 7, further including subjecting dispensed wax to UV radiation.

11. A dispenser for hot depilatory wax comprising in combination:

a base adapted to rest on a generally horizontally extending surface;

a support arm extending vertically from said base;

a housing supported by said arm for receiving a container of wax and supporting said container over a wax tank in said housing so that wax can flow out of said container into said tank;

a heating element for heating wax in said tank;

a flow control valve having an inlet and an outlet, said flow control valve opening and closing in response to electrical command signals;

a conduit connecting an opening in said tank to said inlet;

said outlet directing hot wax flowing through said valve toward a plate adapted to support a hot wax-dispensing dish.

12. A dispenser for hot depilatory wax as in claim 11, wherein said electrical command signals are generated by a microprocessor whose inputs include a signal indicative of the temperature of said reservoir.

* * * * *